US009956697B2

(12) United States Patent
Pragt et al.

(10) Patent No.: US 9,956,697 B2
(45) Date of Patent: May 1, 2018

(54) PERSONAL CARE DEVICE AS WELL AS A CUTTING UNIT FOR SUCH A PERSONAL CARE DEVICE

(71) Applicant: KONINKLIJKE PHILIPS N.V., Eindhoven (NL)

(72) Inventors: Johan Pragt, Eindhoven (NL); Wouter Van Kempen, Eindhoven (NL); Robert Alexander Van Eibergen Santhagens, Eindhoven (NL); Tarek Zeinel-Din, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 101 days.

(21) Appl. No.: 14/904,976

(22) PCT Filed: Jul. 16, 2014

(86) PCT No.: PCT/EP2014/065212
§ 371 (c)(1),
(2) Date: Jan. 14, 2016

(87) PCT Pub. No.: WO2015/010979
PCT Pub. Date: Jan. 29, 2015

(65) Prior Publication Data

US 2016/0158947 A1 Jun. 9, 2016

(30) Foreign Application Priority Data

Jul. 25, 2013 (EP) ..... 13177931

(51) Int. Cl.
*B26B 19/38* (2006.01)
*B26B 19/14* (2006.01)

(52) U.S. Cl.
CPC ..... *B26B 19/3846* (2013.01); *B26B 19/14* (2013.01); *B26B 19/141* (2013.01); *B26B 19/143* (2013.01)

(58) Field of Classification Search
CPC .. B26B 19/3846; B26B 19/141; B26B 19/143
(Continued)

(56) References Cited

U.S. PATENT DOCUMENTS 2,261,275 A * 11/1941 Pasinski ..... B26B 19/12 30/346.51
2,494,464 A 1/1950 Vivie
(Continued)

FOREIGN PATENT DOCUMENTS

HU 146204 A 4/1958

*Primary Examiner* — Hwei C Payer

(57) ABSTRACT

A personal care device is provided with a cutting unit comprising an external cutting member and an internal cutting member. A virtual skin plane is located on a side of the external cutting member facing away from the internal cutting member. The internal cutting member comprises cutting elements each having a first cutting edge. The external cutting member comprises hair-entry apertures each having a second cutting edge. In a starting position of cutting a hair situated in a cutting position in the hair-entry aperture and extending perpendicularly to the virtual skin plane, the first cutting edge is in contact with the hair in a first contact position, and the second cutting edge is in contact with the hair in a second contact position, wherein the first contact position is closer to the virtual skin plane than the second contact position.

9 Claims, 10 Drawing Sheets

(58) Field of Classification Search
USPC ..... 30/43.6
See application file for complete search history.

(56) References Cited

U.S. PATENT DOCUMENTS

| | | | | | |
|---|---|---|---|---|---|
| 2,677,884 | A | | 5/1954 | Richard | |
| 3,225,440 | A | | 12/1965 | Owens | |
| 3,281,937 | A | | 11/1966 | Starre | |
| 3,889,372 | A | | 6/1975 | Sakai | |
| 4,594,778 | A | * | 6/1986 | Dona | B26B 19/12 30/43.6 |
| 4,707,923 | A | * | 11/1987 | Tietjens | B26B 19/141 30/346.51 |
| 4,839,964 | A | * | 6/1989 | Uchiyama | B26B 19/141 30/43.5 |
| 2002/0002773 | A1 | | 1/2002 | Satoh | |
| 2005/0198824 | A1 | | 9/2005 | White | |
| 2008/0148573 | A1 | | 6/2008 | Nakano | |
| 2016/0158947 | A1 | * | 6/2016 | Pragt | B26B 19/14 30/43.6 |

* cited by examiner

PERSONAL CARE DEVICE AS WELL AS A CUTTING UNIT FOR SUCH A PERSONAL CARE DEVICE

This application is the U.S. National Phase application under 35 U.S.C. § 371 of International Application No. PCT/EP2014/065212, filed on Jul. 16, 2014, which claims the benefit of International Application No. 13177931.6 filed on Jul. 25, 2013. These applications are hereby incorporated by reference herein.

FIELD OF THE INVENTION

The invention relates to a personal care device, such as a shaving apparatus, provided with at least one cutting unit comprising an external cutting member and an internal cutting member which is moveable relative to the external cutting member in at least one direction of movement, which internal cutting member comprises a plurality of cutting elements each comprising a first cutting edge, wherein a projection of the first cutting edge in a virtual skin plane, which is located on a side of the external cutting member facing away from the internal cutting member and which extends parallel to said direction of movement and parallel to a skin surface when the cutting unit is in an operational position relative to the skin surface, encloses at least a first shearing angle with said direction of movement, and which external cutting member comprises a plurality of hair-entry apertures each comprising a second cutting edge for cooperation with at least one of the first cutting edges, wherein a projection of the second cutting edge in the virtual skin plane encloses at least a second shearing angle with the direction of movement.

The invention also relates to a cutting unit for such a personal care device.

BACKGROUND OF THE INVENTION

US20080148573A1 disclosed a rotary shaver including an outer cutter frame provided on a shaver main body. An outer cutter is installed in the outer cutter frame and has ring-shaped thin layer portions whose upper surfaces are shaving surfaces. The thin layer portions comprise hair introduction openings. The rotary shaver also comprises an inner cutter with cutter blades. The inner cutter is rotatable, wherein the cutter blades cooperate with the lower surface of the thin layer portions of the outer cutter to cut hair that entered the hair introduction openings. Each of these hair introduction openings is formed along a straight line which is slanted by a constant shearing angle in the rotational direction of the inner cutter.

The shaving surfaces, the lower surface of the thin layer portions as well as the upper edges of the cutter blades extend perpendicularly to the central axis.

The upper cutting edges of the cutter blades are directed towards the lower surface of the thin layer portions of the outer cutter. When cutting a hair, a cutting edge of the cutter blade contacts the hair at a first contact position whilst the cutting edge of a wall defining the hair introduction opening contacts the hair at a second contact position.

In practice there will be a relatively small cutting gap between the lower surface of the outer cutter and the cutting edge of the cutter blade, due to which the first contact position is located further away from the shaving surfaces than the second contact position. Due to the difference in distance to the shaving surface, the forces exerted during the cutting of the hair on the cutting edge of the cutter blade as well as on the cutting edge of the outer cutter, will introduce a torque forcing the cutting edges apart. When the distance between the cutting edges of the inner cutter and outer cutter becomes too large, the cutting of the hair is impeded. To keep the cutting gap as small as possible and theoretically even zero for a good cutting result, an axial force needs to be applied to press the cutting edges of the inner cutter against the lower surface of the outer cutter. However, by pressing the cutting edges of the inner cutter against the lower surface of the outer cutter, larger forces are needed to rotate the inner cutter with respect to the outer cutter. Furthermore, these forces may result in wear of the inner and outer cutter, as well as in heat generation causing less comfort during shaving.

U.S. Pat. No. 3,225,440 discloses an electric shaver having a dome-shaped external cutting member with a plurality of triangularly shaped hair-entry apertures, and having an internal cutting member with two straight radially extending cutting elements each comprising a curved cutting edge matching the dome-shaped external cutting member. Seen in the rotational direction of the internal cutting member, the triangular hair-entry apertures are successively arranged with their base portions facing towards and away from the rotational axis of the internal cutting member. As a result, the rotating cutting edges respectively enclose a positive and a negative shearing angle with the co-operating cutting edges of each two successive hair-entry apertures.

U.S. Pat. No. 3,889,372 discloses a blade assembly for an electric dry shaver including an outer blade and an inner blade rotatable to shave hairs in cooperation with the outer blade. The outer blade has a plurality of slits extending substantially in radial direction. The inner blade and the slits in the outer blades are so arranged that the intersection of their cutting edge lines define an optimum hair holding or cutting angle which is constant at all positions over the blade surface.

SUMMARY OF THE INVENTION

In view of the above, a general object of the present invention is to provide a personal care device, wherein the forces needed to operate the personal care device are reduced.

According to a first aspect, the invention provides a personal care device of the kind mentioned in the opening paragraph, wherein, for at least P % (percent) of all hair-entry apertures of the external cutting member which comprise a second cutting edge for cooperation with at least one of the first cutting edges of the internal cutting member, projections of the first and second cutting edges in a plane extending perpendicularly to the direction of movement enclose, respectively, a first inclination angle and a second inclination angle with the virtual skin plane of the cutting unit, wherein the first and second inclination angles and the first and second shearing angles are selected such that, at least in a starting position of cutting a virtual cylindrical hair with a diameter of 150 microns situated in a cutting position in the hair-entry aperture and extending perpendicularly to the virtual skin plane, the first cutting edge is in contact with the virtual cylindrical hair in a first contact position and the second cutting edge is in contact with the virtual cylindrical hair in a second contact position, wherein the first contact position is closer to the virtual skin plane than the second contact position, and wherein P is at least 60.

Since, in practice, a cross section of a hair can have different dimensions and sizes, a virtual cylindrical hair with a diameter of 150 micrometer is being used as a reference.

The virtual cylindrical hair provides a means to enable selecting the correct first and second inclination angles of the first and second cutting edges as well as the first and second shearing angles, wherein the first contact position is closer to the virtual skin plane than the second contact position.

Due to the difference in distance to the virtual skin plane, the forces exerted during the cutting of an individual virtual cylindrical hair on the first and second cutting edges of respectively the internal and external cutting member will introduce a torque pushing the cutting edges towards each other. Since said difference in distance is present for at least 60% (percent) of all hair-entry apertures of the external cutting member which comprise a second cutting edge for cooperation with at least one of the first cutting edges of the internal cutting member, the total of all hair-cutting forces exerted on the first cutting edges of the internal cutting member and the second cutting edges of the external cutting member pushes the internal cutting member and the external cutting member towards each other. Therefore, means such as for example a spring are not needed in the personal care device to push the cutting edges towards each other.

The relative movement of the internal cutting member with respect to the external cutting member can be a rotational movement or a reciprocating translational movement.

In the case of a reciprocating translational movement, the virtual skin plane extends parallel to the main outer surface of the cutting unit.

In practice, hair will not only extend perpendicularly to the virtual skin plane but also in other directions. Depending on the degree of inclination of the first and second cutting edges as well as the size of the first and second shearing angles, the first contact position will also be closer to the virtual skin plane than the second contact position for hair extending in a range of acute angles with respect to the virtual skin plane.

In practice, hair will have dimensions of varying diameter. The first contact position will also be closer to the virtual skin plane than the second contact position for hair having a diameter smaller or larger than 150 micrometer.

In a preferred embodiment of a personal care device according to the invention, P is at least 80. More preferably, P is 100.

In a preferred embodiment of a personal care device according to the invention, for said at least P % (percent) of all hair-entry apertures of the external cutting member which comprise a second cutting edge for cooperation with at least one of the first cutting edges of the internal cutting member, in each possible cutting position of the virtual cylindrical hair in the hair-entry aperture the first contact position is closer to the virtual skin plane than the second contact position in said starting position, wherein the virtual cylindrical hair extends perpendicularly to the virtual skin plane.

In this manner it is ensured that, independent of the location of the virtual hair with respect to the first cutting edge, the first contact position is closer to the virtual skin plane than the second contact position.

In a preferred embodiment of a personal care device according to the invention, the internal cutting member is rotatable relative to the external cutting member about a central axis of the cutting unit, wherein the virtual skin plane extends perpendicularly to the central axis.

The internal cutting member is movable in a tangential direction about a central axis. The first and second cutting edges will extend at the first and second shearing angles with respect to the tangential direction, due to which the first and second cutting edges will also extend at shearing angles with respect to a radial direction. The plane extending perpendicularly to the direction of movement will extend in the axial direction as well as in the radial direction.

With such a rotating internal cutting member being movable in only one direction, only one side of the hair-entry aperture needs to be provided with the second cutting edge. Other sides of the hair-entry aperture do not need to be provided with cutting edges extending at specific angles. The inclination angles of these other sides in the plane extending in the axial direction as well as in the radial direction, will preferably be the same as the inclination angles of the second cutting edge to provide a relatively smooth inner surface on the external cutting member.

In a preferred embodiment of a personal care device according to the invention, at least one of the hair-entry apertures is bounded by the second cutting edge and an opposite edge, wherein near a first end of the hair-entry aperture the second cutting edge and the opposite edge are connected to each other by a curved part, whilst near a second end of the hair-entry aperture, on a side remote from the curved part, the hair-entry aperture is open.

The hair-entry aperture is open in axial direction and partially in radial direction on the open sides of the U-shape. Hair can enter the hair aperture in both axial and radial direction so that hair can more easily be guided in the hair-entry aperture than in a hair-entry aperture having the shape of a slot or cylindrical opening, wherein the second end of the hair-entry aperture, on a side remote from the curved part of the hair-entry aperture, is being closed In a preferred embodiment of a personal care device according to the invention, at least one of the hair-entry apertures is bounded by the second cutting edge and an opposite edge, wherein near a first end of the hair-entry aperture the second cutting edge and the opposite edge are connected to each other by a curved part, whilst near a second end of the hair-entry aperture on a side remote from the curved part the hair-entry aperture is open, wherein the second cutting edge comprises a first cutting part and a second cutting part connected to the first cutting part, wherein the first cutting part is located closer to the central axis than the second cutting part, wherein a shearing angle enclosed between the first cutting part and the direction of movement is smaller than a shearing angle enclosed by the second cutting part and the direction of movement, and wherein the first and second inclination angles, the first shearing angle and the shearing angle of the first cutting part are selected such that, in a starting position of cutting said virtual cylindrical hair in a position between the first cutting edge and the first cutting part of the second cutting edge, said first contact position is closer to the virtual skin plane than said second contact position.

When the internal cutting member is being rotated in tangential direction, hair located at a distance from the central axis, will be moved by the second cutting part towards the first cutting part. Although the hair can be cut at the second cutting part, it is preferred that the hair is first guided towards the first cutting part and is cut at the first cutting part. Since the first cutting part is located closer to the central axis, the impact of the cutting forces on the personal care device is reduced.

According to a further aspect, the invention provides a personal care device, wherein the first and second inclination angles are between 5 and 30 degrees, preferably 15 degrees.

With such inclination angles, hair can easily enter the hair-entry aperture, whilst due to the presence of several different first and second shearing angles, the first contact position will be closer to the virtual skin plane than the second contact position. Furthermore, such inclination angles enable a good shaving performance as to comfort and closeness to be obtained.

DESCRIPTION OF PREFERRED EMBODIMENTS

In the drawings, like reference numerals refer to like elements.

DESCRIPTION OF PREFERRED EMBODIMENTS

Figure 1A:
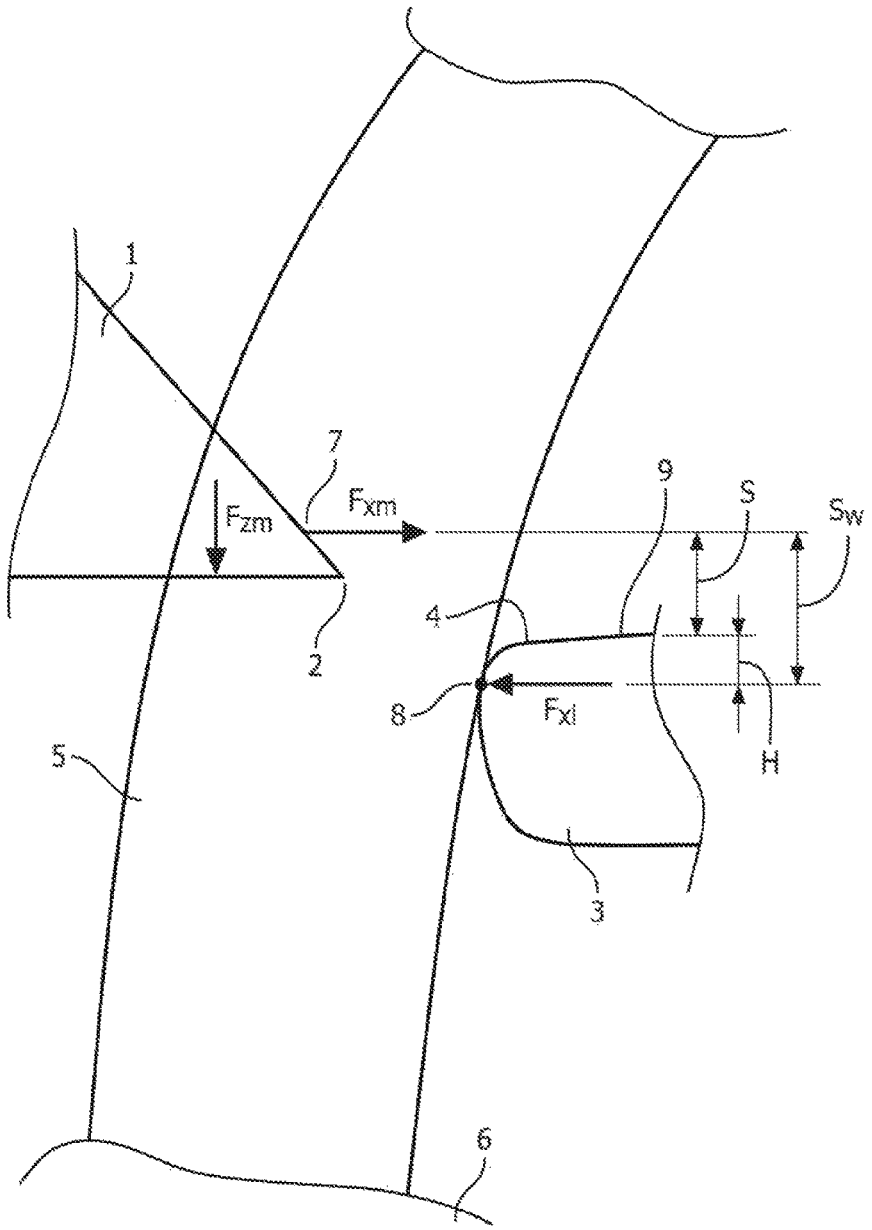
FIG. 1A (PRIOR ART)
FIGS. 1A-1C show, respectively, a side view, a schematic front view and a top view of the cutting of a hair according to the prior art.
Figure 1C:
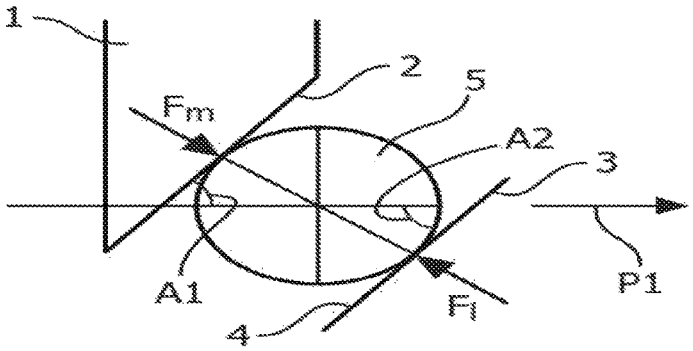
FIG. 1C (PRIOR ART)
Figure 1B:
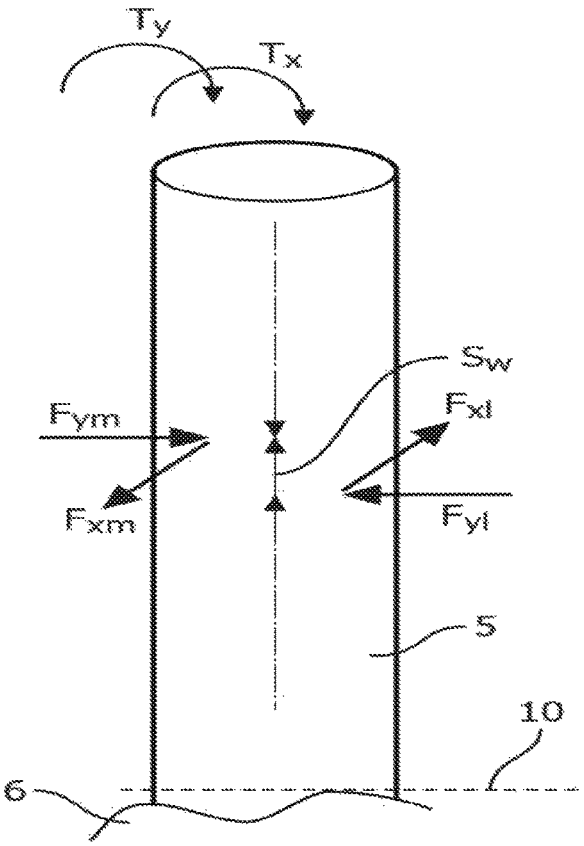
FIG. 1B (PRIOR ART)

FIGS. 1A-1C show, respectively, a side view, a schematic front view and a top view of the cutting of a hair by means of a personal care device such as a shaver according to the prior art.

Such a personal care device comprises at least an internal cutting member 1 with a first cutting edge 2 and an external cutting member 3 with a second cutting edge 4. When cutting a hair 5 extending from the skin 6 of a person, the hair will contact the first cutting edge 2 at a first contact position 7 and contact the second cutting edge 4 at a second contact position 8. Due to the rounded shape of the external cutting member 3, the second contact position 8 will be located at a distance H from the inner surface 9 of the external cutting member 3. The distance S is the distance between the first cutting edge 2 and the inner surface 9 of the external member 3, whilst $S_w$ is the effective cutting gap between the first and second contact position 7, 8, wherein $S_w$=S+H. The internal cutting member 1 is movable with respect to the external cutting member 3 in a direction indicated by arrow P1. The first and second cutting edges 2, 4 extend at shearing angles A1, A2 with respect to the direction of movement. The effective cutting gap $S_w$ varies during the cutting of the hair due to the shape of the internal cutting member 1 and depends on the position of the cutting edges 2, 4 in the hair 5 in the direction indicated by arrow P1. The distance $S_w$ is the largest during cutting the first half of the hair.

When cutting the hair 5, forces $F_m$ and $F_l$ will be exerted on the hair by the internal cutting member 1 and the external cutting member 3. Due to the shearing angles A1, A2, the forces $F_m$ and $F_l$ result in forces $F_{yM}$, $F_{xM}$, $F_{xL}$, $F_{yL}$. Since the force $F_{xM}$ is located at a larger distance from a virtual skin plane 10 extending substantially parallel to the skin 6 than the force $F_{xL}$, the forces $F_{xM}$ and $F_{xL}$ result in a torque $T_x$. The difference in distance is the distance $S_w$. Due to the torque $T_x$, the first cutting edge 2 will be pushed away from the second cutting edge 3. To maintain a constant distance between first and second cutting edges 2, 4, a force $F_{zM}$ needs to be applied to the internal cutting member 2 extending perpendicularly to the forces $F_{xM}$ and $F_{yM}$. Due to this force $F_{zM}$, wear and heat generation will occur. The forces $F_{yM}$ and $F_{yL}$ will also result in a torque $T_y$. This torque $T_y$ will be taken care of by the bearing of the internal cutting member 2.

In the above described personal care device according to the prior art, the effective cutting gap $S_w$ is larger that zero.

In the case of the personal care device according to the invention, as will be shown below, the effective cutting gap $S_w$ is equal to or smaller than zero, so in fact it is negative. This means that when cutting a hair, with respect to the hair 5, the first contact position 7 on internal first cutting edge 2 will be located closer to the virtual skin plane 10 than the second contact position 8 on external second cutting edge 4. Due to the relative locations of the first and second contact positions 7, 8, the torque $T_x$ will push the first cutting edge 2 towards the second cutting edge 3 instead of pushing it away like in the prior art device.

Figure 2:
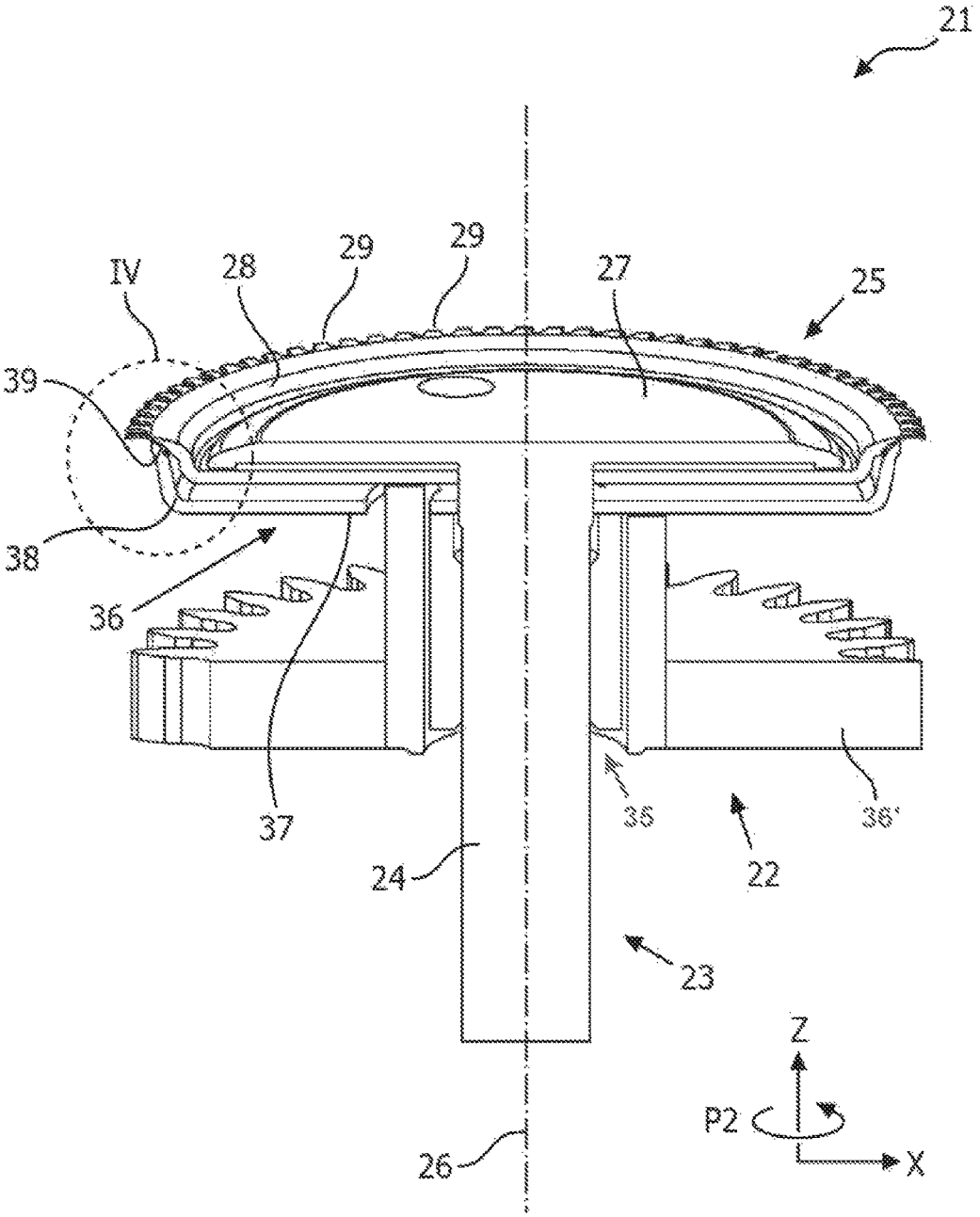
FIG. 2 shows a perspective cross section of a part of a first embodiment of the personal care device according to the invention.
Figure 3:
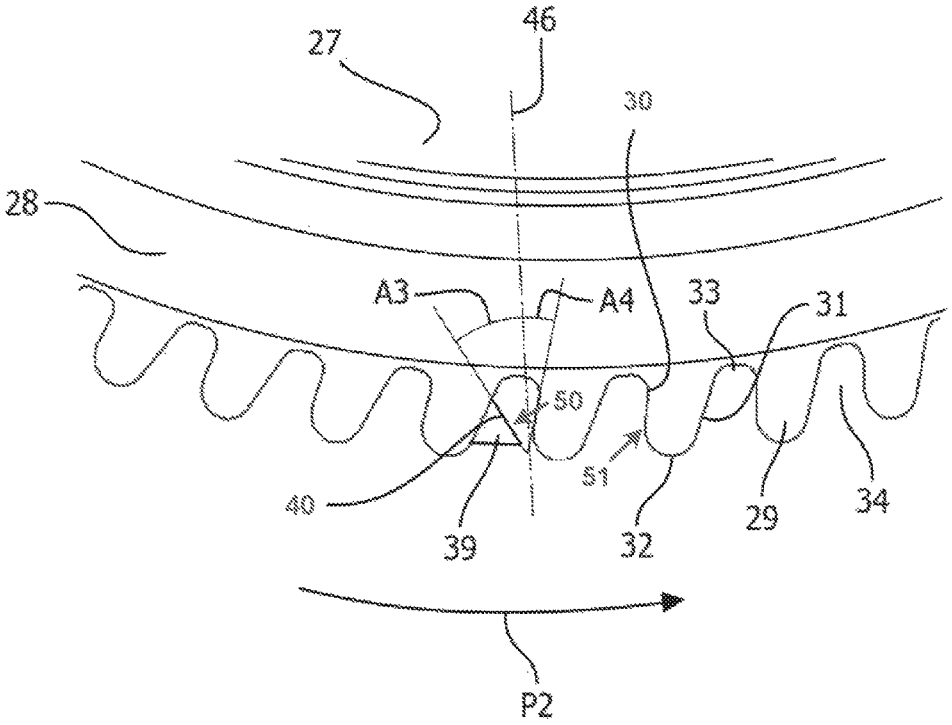
FIG. 3 shows a top view of the personal care device as shown in FIG. 2.
Figure 4:
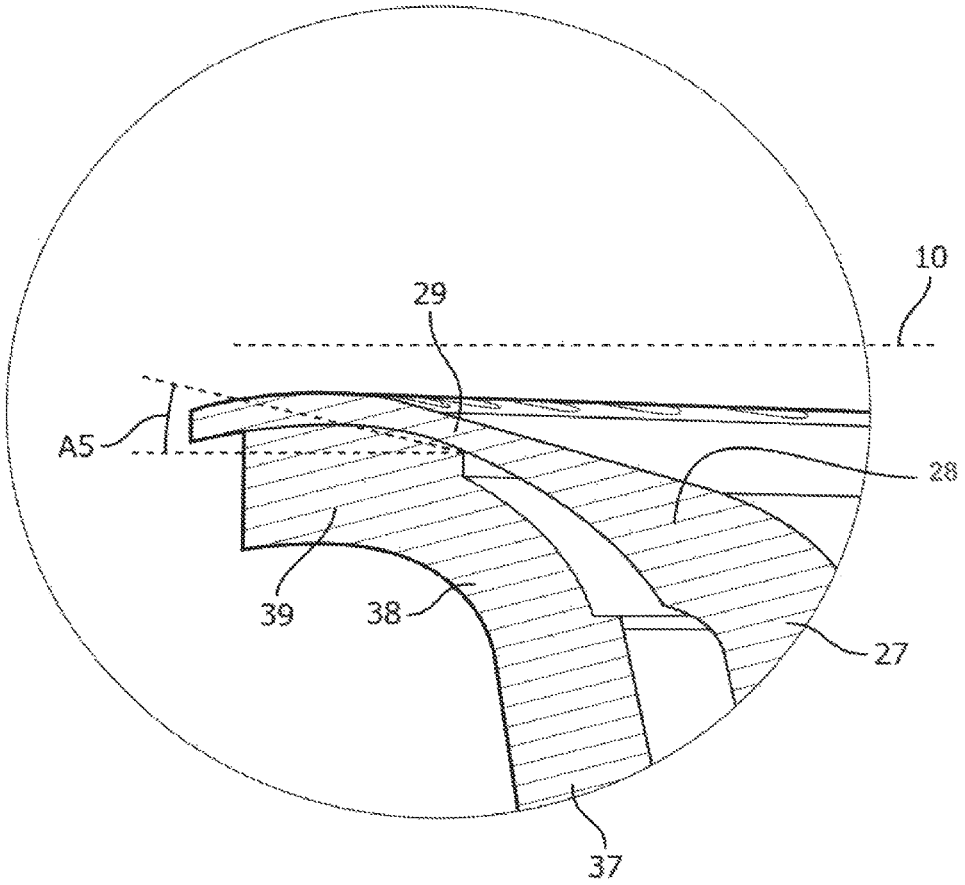
FIG. 4 shows an enlarged part of the personal care device as shown in FIG. 2.

FIGS. 2-4 show different views of a cutting unit 21 of a first embodiment of a personal care device according to the invention. Personal care devices with cutting units are well known in the art and are not further described in detail. The personal care device may be a shaver, a trimmer, a grooming device or other kind of cutting device. The cutting units of such a personal care device all comprise internal and external cutting members, wherein the internal cutting member is either rotatable or translatable with respect to the external cutting member.

The cutting unit 21 comprises an internal cutting member 22 and an external cutting member 23. The external cutting member 23 comprises a central shaft 24 and a disc 25 extending perpendicularly thereto. The central shaft 24 extends parallel to a central axis 26. The disc 25 comprises a main part 27 extending perpendicularly to the central axis 26. Near the outer circumferential edge, the disc 25 comprises a bent part 28 with a number of teeth 29. The teeth 29 are located, in the axial direction, at a distance from the main part 27. As can be seen in FIG. 3, each tooth 29 comprises a first and a second side 30, 31 which sides are connected to each other via a curved part 32. Teeth 29 located adjacent to each other are connected to each other via a curved part 33. Between the teeth 29, a plurality of U-shaped hair-entry apertures 34 of the external cutting member 23 are located.

The internal cutting member 22 comprises a hollow shaft 35, a disc 36 extending perpendicularly thereto as well as a gear 36' extending parallel to the disc 36. The hollow shaft 35 extends coaxially with the shaft 24 of the external cutting member 23. The gear 36' is connected to other driving means for rotating the internal cutting member 22 about the central axis 26 in a direction indicated by arrow P2. Such driving means are well known in the art and are not further described. The disc 36 comprises a main part 37 extending perpendicularly to the central axis 26. Near the outer circumferential edge, the disc 36 comprises a bent part 38 with a number of teeth 39 forming a plurality of cutting elements of the internal cutting member 22. The teeth 39 are located close to the teeth 29.

A first side 40 of each tooth 39 forms a first cutting edge 50 which cooperates with the first side 30 of a tooth 29 which forms a second cutting edge 51.

As can clearly be seen in FIG. 3, the first cutting edge 50 encloses a shearing angle A3 with a line 46 extending in radial direction, whilst the second cutting edge 51 encloses a shearing angle A4 with line 46. Both shearing angles A3, A4 are larger than zero degrees.

As can be seen in FIG. 4, the teeth 29, 39 of the internal cutting member 22 and external cutting member 23 are inclined with respect to the virtual plane 10 and enclose an inclination angle A5 therewith. The virtual plane 10 extends perpendicularly to the central axis 26 (FIG. 4) and is located on a side of the external cutting member 23 facing away from the internal cutting member 22.

When the personal care device is being operated, the internal cutting member 22 rotates about the central axis 26, which will extend substantially perpendicularly to the skin surface of a person. A hair will be captured in hair-entry apertures 34. By further movement of the internal cutting member 22, the captured hair will be cut by the cooperating first and second cutting edges 50, 51.

Figure 5A:
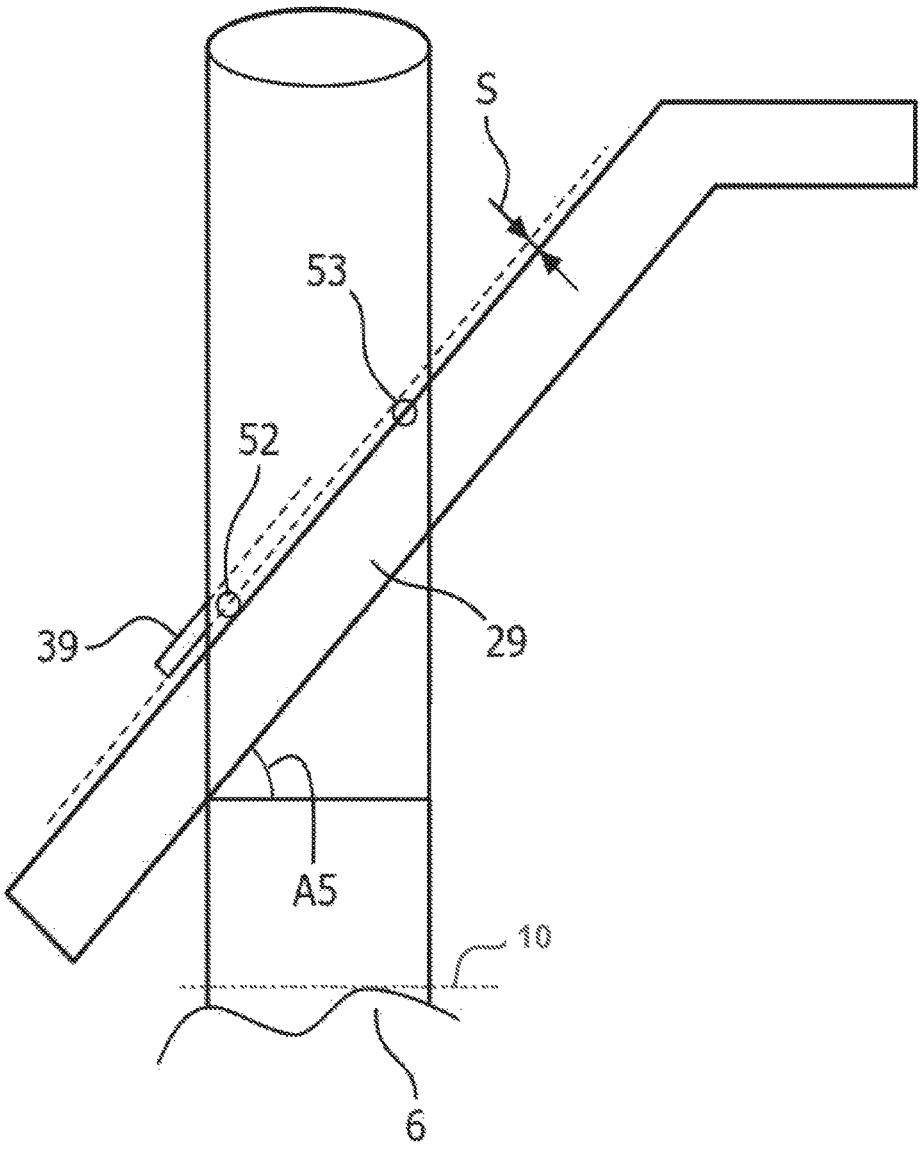
FIGS. 5A-5C show, respectively, a side view, a schematic front view and a top view of the cutting of a hair according to the invention.
Figure 5C:
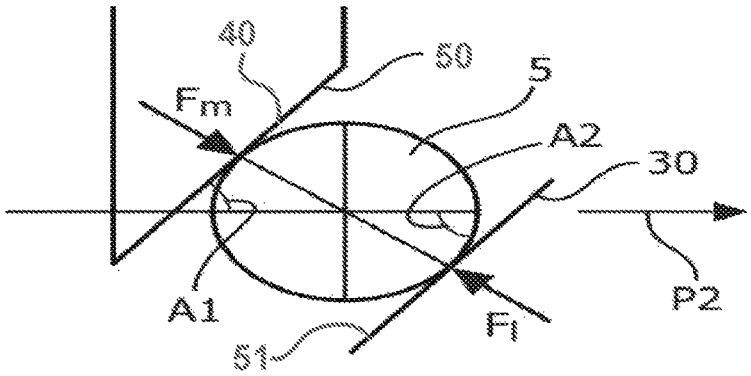
Figure 5B:
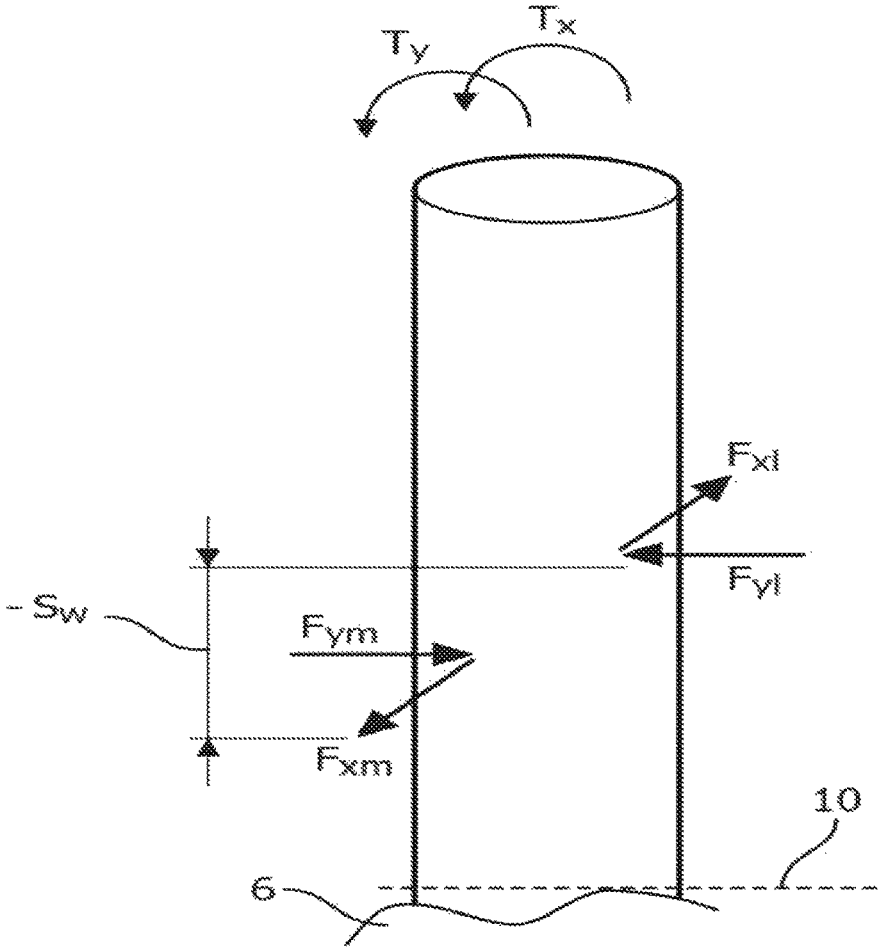

FIGS. 5A-5C show schematically a hair 5 being cut by first and second cutting edges 50, 51, wherein the first and second cutting edges 50, 51 extend at shearing angles A1, A2 with respect to the direction indicated by arrow P2 and are inclined, at an inclination angle A5, with respect to the skin surface and the virtual skin plane 10.

When cutting the hair 5, the hair 5 will contact the first cutting edge 50 at a first contact position 52 and will contact the second cutting edge 51 at a second contact position 53. Forces $F_{yM}$, $F_{xM}$, $F_{xL}$, $F_{yL}$ will be exerted on the hair 5 by cutting edges 50, 51. Due to the angles A1, A2 and A5, the forces $F_{xM}$, $F_{yM}$ exerted by the first cutting edge 50 of the internal cutting member 22 are located at a smaller distance from a virtual skin plane 10 than the forces $F_{xL}$, $F_{yL}$ exerted by the second cutting edge 51 of the external cutting member 23. The difference in distance is the distance $-S_w$. The forces $F_{xM}$ and $F_{xL}$ result in a torque $T_x$. The direction of the torque $T_x$ is opposite to the direction of the torque as shown in FIG. 1. Due to the torque $T_x$, the first cutting edge 50 will not be pushed away from the second cutting edge 51 like in the prior art device, but will be pushed towards it. To maintain a constant distance S between first and second cutting edges 50, 51, no or nearly no force need be applied on the internal cutting member 22 in a direction perpendicular to the forces $F_{xM}$ and $F_{yM}$. Since nearly no such force need be applied, nearly no wear and heat generation will occur. The forces $F_{yM}$ and $F_{yL}$ will result in a torque $T_y$. This torque $T_y$ will be taken care of by the bearing of the internal cutting member 22.

It is noted that, in the cutting unit 21 of the first embodiment of a personal care device according to the invention, for all hair-entry apertures 34 of the external cutting member 23, which comprise a second cutting edge 51 for cooperation with at least one of the first cutting edges 50 of the internal cutting member 22, the forces exerted on the hairs 5 by the first cutting edges 50 of the internal cutting member 22 are located at a smaller distance from the virtual skin plane 10 than the forces exerted on the hairs 5 by the second cutting edges 51 of the external cutting member 23. To prevent the internal cutting member 22 from being pushed away from the external cutting member 23 under the influence of the hair-cutting forces and to prevent the required use of a compensating force, e.g. a spring force, pushing the internal cutting member 22 and the external cutting member 23 towards each other, it is not necessary that for all hair-entry apertures 34 of the external cutting member 23 the forces exerted on the hairs 5 by the first cutting edges 50 of the internal cutting member 22 are located at a smaller distance from the virtual skin plane 10 than the forces exerted by the second cutting edges 51 of the external cutting member 23. According to the present invention, for a percentage of at least 60% (percent) of all hair-entry apertures 34 of the external cutting member 23, which comprise a second cutting edge 51 for cooperation with at least one of the first cutting edges 50 of the internal cutting member 22, the shearing angles A3, A4 and the inclination angles A5 of the internal cutting member 22 and the external cutting member 23 should be selected such that, in the starting position of cutting the hair 5 situated in a cutting position in the hair-entry aperture 34 and extending perpendicularly to the virtual skin plane 10, the first cutting edge 50 of the internal cutting member 22 is in contact with the hair 5 in a first contact position and the second cutting edge 51 of the external cutting member 23 is in contact with the hair 5 in a second contact position, wherein the first contact position is closer to the virtual skin plane 10 than the second contact position. When said percentage is at least 60%, the average of all hair-cutting forces exerted on the first cutting edges 50 of the internal cutting member 22 and on the second cutting edges 51 of the external cutting member 23 will force the internal cutting member 22 and the external cutting member 23 towards each other. More preferably, said percentage is at least 80%.

Figure 6:
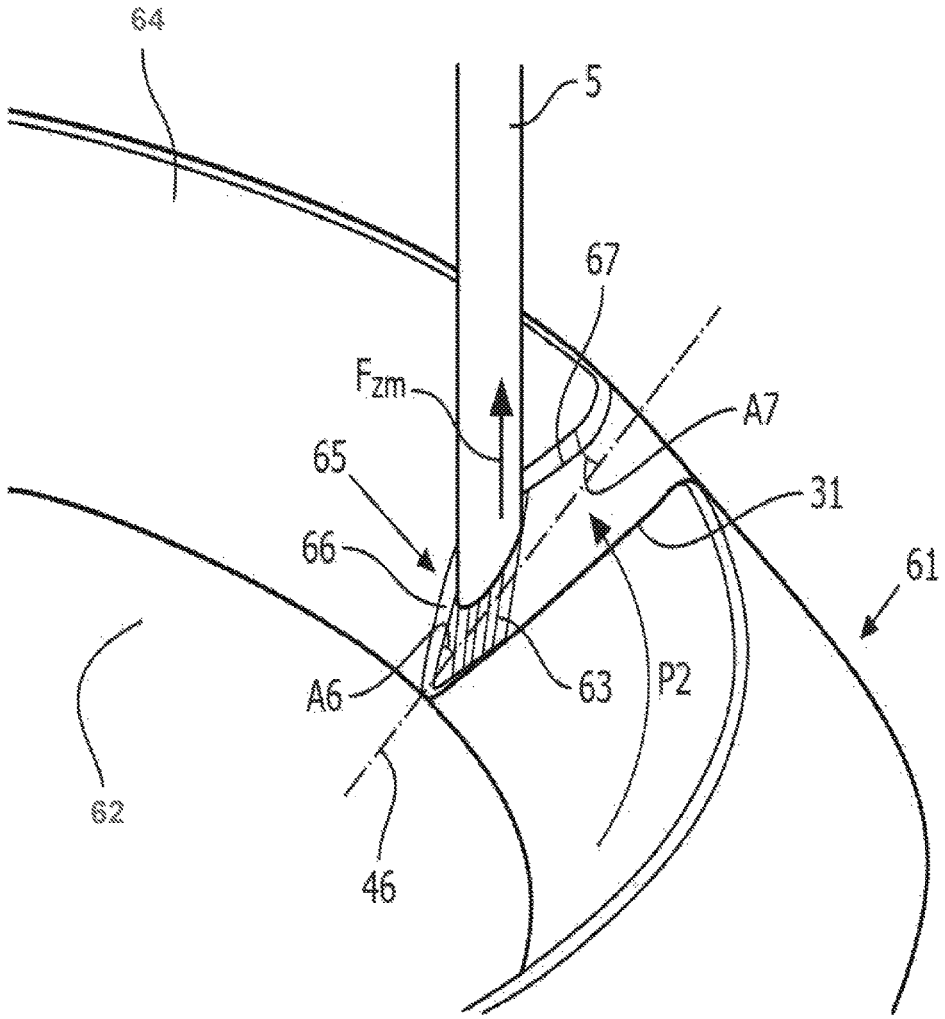
FIG. 6 shows a perspective view of a part of a second embodiment of the personal care device according to the invention.

FIG. 6 shows a schematic view of a further embodiment of a cutting unit 61 of a personal care device according to the invention; the cutting unit comprises an internal cutting member 62 with first cutting edges 63 and an external cutting member 64 with second cutting edges 65. The internal cutting member 62 is rotatable about the central axis 26 (not shown in FIG. 6) with respect to the external cutting member 64. In FIG. 6 only one first cutting edge 63 and only one second cutting edge 65 are shown. Like the above-described cutting unit 21, the cutting unit 61 comprises a number of said cutting edges 63, 65. The second cutting edge 65 comprises a first cutting part 66 and a second cutting part 67 connected thereto. The first cutting part 66 is located closer to the central axis 26 than the second cutting part 67. The first cutting part 66 encloses a shearing angle A6 with the radially extending line 46 and extends from the line 46 in the direction indicated by arrow P2, whilst the second cutting part 67 encloses a shearing angle A7 with the radially extending line 46 and extends from the line 46 in a direction opposite to the direction indicated by arrow P2. When cutting a hair 5, said hair 5 being in contact with the second cutting part 67 will be pushed towards the central axis 26 and will be cut at the first cutting part 66. In the embodiment of the cutting unit 61 as shown in FIG. 6, the first inclination angle of the first cutting edge 63, the second inclination angle of the second cutting edge 65, the first shearing angle of the first cutting edge 63, and the shearing angle A6 of the first cutting part 66 of the second cutting edge 65 are selected such that, when the hair 5 is in the starting position for being cut by the first cutting edge 63 and the first cutting part 66 of the second cutting edge 65, the first contact position between the hair 5 and the first cutting edge 63 is closer to the virtual skin plane than the second contact position between the hair 5 and the first cutting part 66 of the second cutting edge 65. Since the first cutting part 66 is located closer to the central axis 26, the impact of the cutting forces on the personal care device is further reduced.

Figure 7:
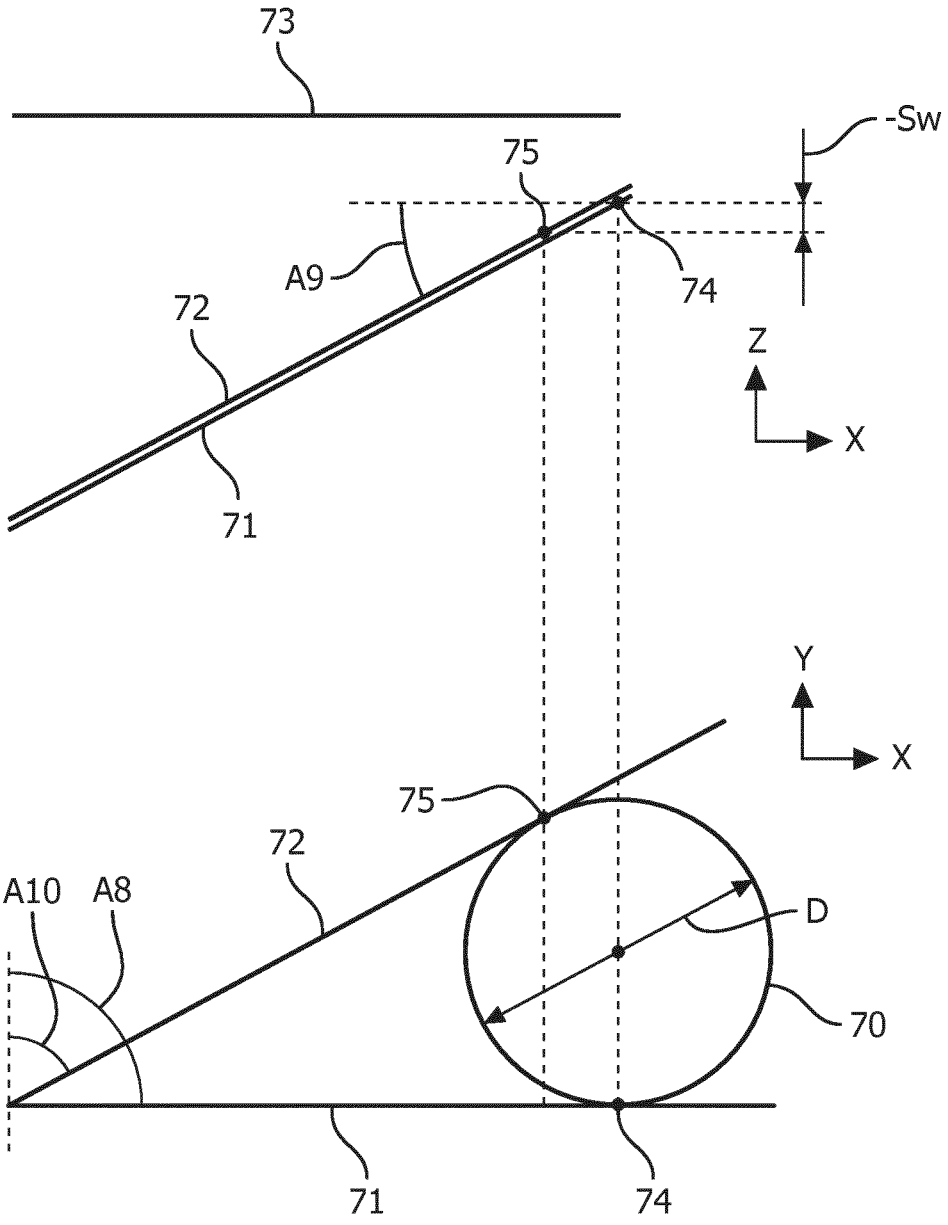
FIG. 7 shows first and second cutting edges of the personal care device as shown in FIG. 2 in an X,Y-plane and an X,Z-plane.

FIG. 7 shows schematically the principle of cutting a hair 70 with a diameter D of 150 micrometer by means of a first cutting edge 71 and a second cutting edge 72. The average diameter of a hair is 150 micrometer. The principle of cutting hair will also work for hair of different diameter. The first cutting edge 71 is movable in Y-direction with respect to the first cutting edge 72. A virtual plane 73 extending in X-Y-direction extends parallel to a skin surface of a user and perpendicularly to the Z-direction.

The first cutting edge 71 extends at a shearing angle A8 of 90 degrees with respect to the direction of movement and at an inclination angle A9 with respect to the virtual plane 73.

The second cutting edge 72 extends at a shearing angle A10 with respect to the direction of movement and also at the inclination angle A9 with respect to the virtual plane 73.

At the starting position of cutting the hair 70, the first cutting edge 71 contacts the hair 70 at a first contact position 74, whilst the second cutting edge 72 contacts the hair 70 at a second contact position 75. Due to the angles A8, A9 A10, the first contact position 74 is located closer to the virtual skin plane 73 than the second contact position 75, resulting in a torque $T_x$, as explained above, forcing the first cutting edge 71 towards the second cutting edge 72.

The inclination angles A9 of the first and second cutting edges 71, 72 are preferably about 5 to about 30 degrees, and more preferably about 15 degrees.

The size of the angles A8, A9, A10 will determine if the first contact position 74 is located closer to the virtual skin plane 73 than the second contact position 75.

Figure 8:
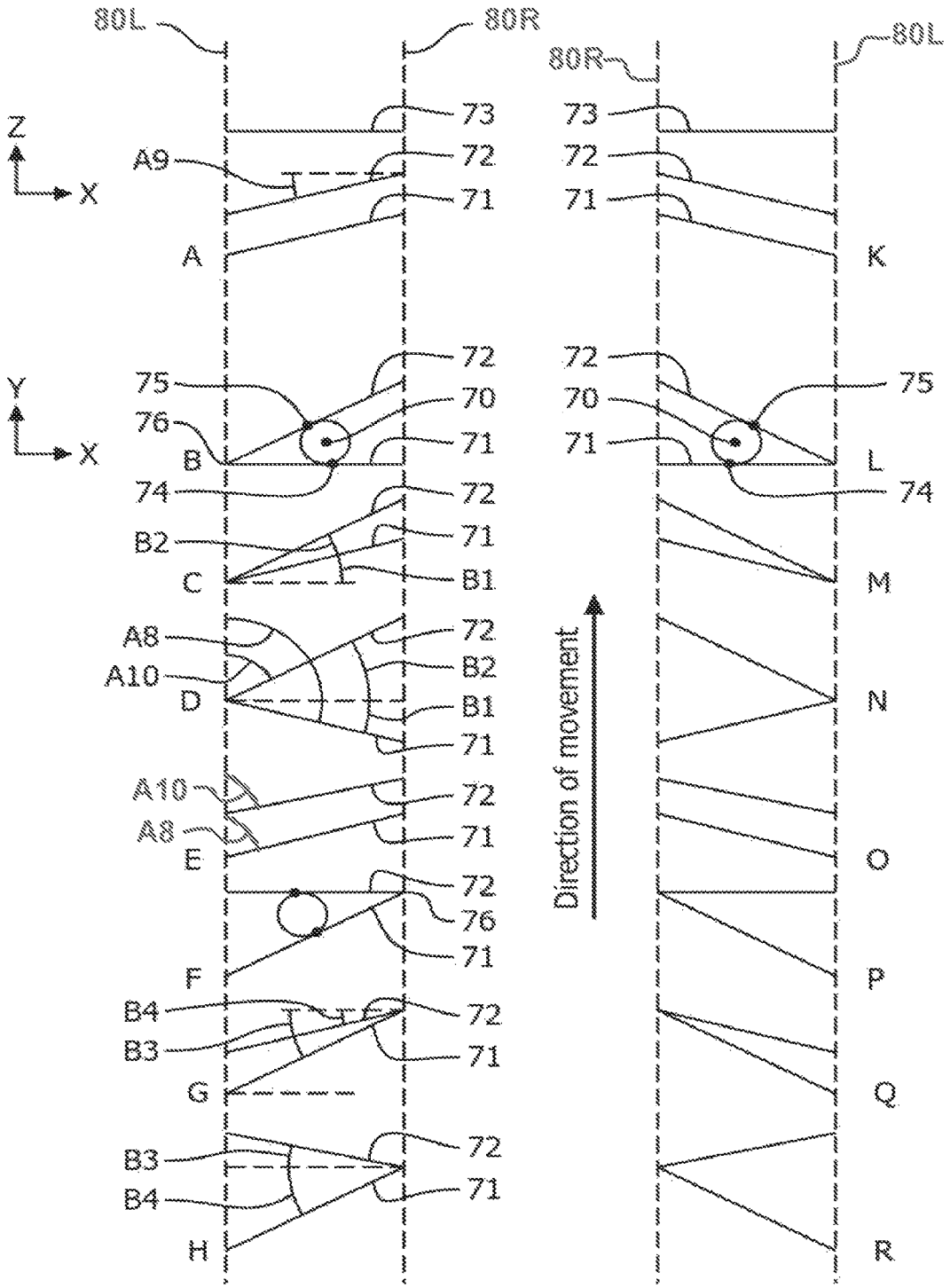
FIG. 8 shows a schematic view of several other embodiments of the personal care device according to the invention, with first and second cutting edges in X,Y-planes and X,Z-planes.

FIG. 8 shows different relative positions A-R of the first and second cutting edges 71, 72 with respect to the virtual plane 73, wherein positions A and K show the first and second cutting edges 71, 72 in a X,Z-plane, wherein the distance between the first and second cutting edges 71, 72 are exaggerated to be able to show both cutting edges. In practice, the distance in Z-direction is as small as possible. The positions B-H and L-R show the first and second cutting edges 71, 72 in a X,Y-plane. The Y-direction indicates the direction of movement. This can be a linear reciprocating movement or a rotational movement. In the case of a rotational movement, the X-direction indicates the radial direction, the Y-direction indicates the tangential direction, whilst the Z-direction indicates the axial direction.

As can be seen in FIG. 8A, the left sides 80L of the cutting edges 71, 72 are located further away from the virtual skin plane 73 than the right sides 80R.

For the positions B-D, the cutting edges 71, 72 intersect at intersection point 76, which intersection point 76 is located on the left sides 80L of the cutting edges 71, 72. For these three embodiments, the shearing angles B1, B2 of the first and second cutting edges 71, 72 with respect to the X-direction are such that the absolute value of B2 is larger than the absolute value of B1.

For position E, the shearing angle A8=A10.

For positions F-H, the cutting edges 71, 72 intersect at intersection point 76, which intersection point 76 is located on the right sides 80R of the cutting edges 71, 72. For these three embodiments, the shearing angles B3, B4 of the first and second cutting edges 71, 72 with respect to the X-direction are such that the absolute value of B4 is smaller than the absolute value of B3.

In all these embodiments, the first contact position 74 is located closer to the virtual skin plane 73 than the second contact position 75.

As can be seen, positions K-R are a mirror image of the positions A-H, so that the working principle is the same.

The person skilled in the art will realize that the present invention is by no means limited to the preferred embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

Any reference signs in the scope should not be construed as limiting the scope of the claims.

LIST OF REFERENCE SIGNS

1 member
2 edge
3 member
4 edge
5 hair
6 skin
7 position
8 position
9 surface
10 virtual skin plane
21 cutting unit
22 internal cutting member
23 external cutting member
24 shaft
25 disc
26 central axis
27 part
28 tooth
29 side
30 side
31 part
33 part
34 hair-entry aperture
35 shaft
36 disc
36' gear
37 part
38 part
39 tooth
40 side
46 line
50 first cutting edge
51 second cutting edge
52 position
53 position
61 unit
62 member
63 edges
64 member
65 edges
66 first cutting part
67 second cutting part
70 hair
71 edge
72 edge
73 plane
74 first contact position
75 second contact position
76 point
A1 angle
A2 angle
A4 angle A3 angle
A5 angle
A7 angle
A8 angle
A9 angle
A10 angle
B1 angle
B2 angle
B3 angle
B4 angle
D diameter
$F_m$ force
$F_l$ force
$F_{yM}$ force
$F_{xM}$ force
$F_{xL}$ force
$F_{yL}$ force
H distance
L left sides
P1 arrow
P2 arrow
R right sides
S distance
$T_x$ torque
$T_y$ torque
$S_w$ gap

The invention claimed is:

1. A personal care device provided with at least one cutting unit, each cutting unit comprising:

an external cutting member and an internal cutting member which is moveable relative to the external cutting member in at least one direction of movement, wherein the internal cutting member includes a plurality of cutting elements each having a first cutting edge, wherein a projection of the first cutting edges in a virtual skin plane, which is located on a side of the external cutting member facing away from the internal cutting member and which extends parallel to said direction of movement and parallel to a skin surface when the cutting unit is in an operational position relative to the skin surface, encloses at least a first shearing angle with said direction of movement, wherein the external cutting member includes a plurality of hair-entry apertures each having a second cutting edge for cooperation with at least one of the first cutting edges, wherein a projection of the second cutting edges in the virtual skin plane encloses at least a second shearing angle with the direction of movement, characterized in that, for at least a percentage of at least 60 of all the hair-entry apertures of the external cutting member each having the second cutting edge for cooperation with at least one of the first cutting edges of the internal cutting member, the projections of the first and second cutting edges in a plane extending perpendicularly to the direction of movement enclose, respectively, a first inclination angle and a second inclination angle with the virtual skin plane of the cutting unit, wherein the first and second inclination angles and the first and second shearing angles are selected such that, at least in a starting position of cutting a virtual cylindrical hair with a diameter of 150 microns situated in a cutting position in the hair-entry aperture and extending perpendicularly to the virtual skin plane, the first cutting edge is in contact with the virtual cylindrical hair in a first contact position and the second cutting edge is in contact with the virtual cylindrical hair in a second contact position, and wherein the first contact position is closer to the virtual skin plane than the second contact position.

2. A personal care device according to claim 1, wherein the percentage of all the hair-entry apertures of the external cutting member each having the second cutting edge for cooperation with at least one of the first cutting edges of the internal cutting member is at least 80.

3. A personal care device according to claim 1, wherein the percentage of all the hair-entry apertures of the external cutting member each having the second cutting edge for cooperation with at least one of the first cutting edges of the internal cutting member is 100.

4. A personal care device according to claim 1, wherein the percentage of at least 60 of all the hair-entry apertures of the external cutting member each having the second cutting edge for cooperation with at least one of the first cutting edges of the internal cutting member, in each cutting position of the virtual cylindrical hair in the hair-entry aperture the first contact position is closer to the virtual skin plane than the second contact position in said starting position, and wherein the virtual cylindrical hair extends perpendicularly to the virtual skin plane.

5. A personal care device according to claim 1, wherein the internal cutting member is rotatable relative to the external cutting member about a central axis of the cutting unit, and wherein the virtual skin plane extends perpendicularly to the central axis.

6. A personal care device according to claim 1, wherein at least one of the hair-entry apertures is bounded by the second cutting edge and an opposite edge, and wherein near a first end of the hair-entry aperture the second cutting edge and the opposite edge are connected to each other by a curved part, whilst near a second end of the hair-entry aperture on a side remote from the curved part the hair-entry aperture is open.

7. A personal care device according to claim 1, wherein at least one of the hair-entry apertures is bounded by the second cutting edge and an opposite edge, wherein near a first end of the hair-entry aperture the second cutting edge and the opposite edge are connected to each other by a curved part, whilst near a second end of the hair-entry aperture on a side remote from the curved part the hair-entry aperture is open, wherein the second cutting edge includes a first cutting part and a second cutting part connected to the first cutting part, wherein the first cutting part is located closer to the central axis than the second cutting part, wherein a shearing angle enclosed between the first cutting part and the direction of movement is smaller than a shearing angle enclosed by the second cutting part and the direction of movement, and wherein the first and second inclination angles, the first shearing angle and the shearing angle of the first cutting part are selected such that, in a starting position of cutting said virtual cylindrical hair in a position between the first cutting edge and the first cutting part of the second cutting edge, said first contact position is closer to the virtual skin plane than said second contact position.

8. A personal care device according to claim 1, wherein the first and second inclination angles are between 5 and 30 degrees.

9. A cutting unit for a personal care device according to claim 1.

* * * * *